US011179586B2

(12) United States Patent
Reed

(10) Patent No.: US 11,179,586 B2
(45) Date of Patent: Nov. 23, 2021

(54) CONCERTINA SMOKE OR FIRE BARRIER

(71) Applicant: Coopers Fire Ltd., Havant (GB)

(72) Inventor: James Martin Reed, Alverstoke (GB)

(73) Assignee: Coopers Fire Ltd, Havant (GB)

( * ) Notice: Subject to any disclaimer, the term of this patent is extended or adjusted under 35 U.S.C. 154(b) by 0 days.

(21) Appl. No.: 16/318,730

(22) PCT Filed: Jul. 18, 2017

(86) PCT No.: PCT/GB2017/052115
§ 371 (c)(1),
(2) Date: Jan. 18, 2019

(87) PCT Pub. No.: WO2018/015742
PCT Pub. Date: Jan. 25, 2018

(65) Prior Publication Data

US 2019/0217135 A1 Jul. 18, 2019

(30) Foreign Application Priority Data

Jul. 20, 2016 (GB) ..... 1612575

(51) Int. Cl.
*A62C 2/10* (2006.01)
*A62C 3/02* (2006.01)

(52) U.S. Cl.
CPC ..... *A62C 2/10* (2013.01); *A62C 3/0257* (2013.01)

(58) Field of Classification Search
CPC ..... A62C 2/10; A62C 3/0257
USPC ..... 169/48–50
See application file for complete search history.

(56) References Cited

FOREIGN PATENT DOCUMENTS

FR 2 684 008 A1 5/1993
WO 2015/055990 A2 4/2015

*Primary Examiner* — Christopher S Kim
(74) *Attorney, Agent, or Firm* — Bay State IP, LLC

(57) ABSTRACT

A concertina smoke or fire barrier comprising a curtain having a plurality of concertina-fold curtain webs and a plurality of concertina flanges. The flanges extend from a stitching joint between each adjacent pair of curtain webs. Normally closed door opening in the curtain, the door opening being provided by a slit extending through several of curtain webs and their flanges. Cuts in the flanges adjacent to the slit allow flange portions between the slit and the cuts to be stitched against their webs. A strip of curtain web material is stitched to the curtain webs on one side of the slit for covering it when the door opening is closed. Hook and loop fastening tape is located on both sides of the slit, one piece of the tape being stitched to the strip and another complementary piece being stitched to the curtain webs to the other side of the slit.

11 Claims, 4 Drawing Sheets

CONCERTINA SMOKE OR FIRE BARRIER

CROSS REFERENCE TO RELATED APPLICATION

This application is for entry into the U.S. National Phase under § 371 for International Application No. PCT/GB2017/052115 having an international filing date of Jul. 18, 2017, and from which priority is claimed under all applicable sections of Title 35 of the United States Code including, but not limited to, Sections 120, 363, and 365(c), and which in turn claims priority under 35 USC 119 to Great Britain Patent Application No. 1612575.9 filed on Jul. 20, 2016.

The present invention relates to a concertina smoke or fire barrier.

Normally fire and/or smoke barriers having a curtain include a roller from which the curtain is unwound for deployment of the curtain. Recently, concertina curtains have been available. Typically they comprise:

- a plurality of concertina-fold, curtain webs,
- a plurality of concertina flanges, a flange extending from a stitching joint between each adjacent pair of curtain webs and
- a tray to which a foot of the curtain is secured.

The flanges, in particular, render difficult provision of a personnel escape door.

The object of the present invention is to provide concertina smoke or fire barrier having a personnel escape door.

According to the invention there is provided a concertina smoke or fire barrier comprising:

- a curtain having:
  - a plurality of concertina-fold, curtain webs and
  - a plurality of concertina flanges, a flange extending from a stitching joint between each adjacent pair of curtain webs,
- a normally closed door opening in the curtain, the door opening being provided by
  - a slit extending through several of curtain webs and their flanges,
  - cuts in the flanges adjacent the slit allowing flange portions between the slit and the cuts to be stitched against their webs,
  - a strip of curtain web material stitched along the length of the slit to the curtain webs to one side of the slit for covering it when the door opening is closed,
  - hook and loop fastening tape on both sides of the slit, one piece of the tape being stitched to the strip and another complementary piece being stitched to the curtain webs to the other side of the slit.

The flange portions, and the flanges, normally comprise two thicknesses of curtain web material. One can be stitched to one side of the stitching joint and the other to the other, or both can be stitched to the same side.

The strip, and the complementary piece of tape, can be stitched to the sides of the webs away from the flanges. In the preferred embodiment, they are stitched over the cut flange portions.

Normally the curtain will have a tray to which its foot is secured and in which it is folded prior to deployment. A door part of the curtain adjacent the slit is free from the tray for opening of the door. The door may have slits along both sides, to enable it to flap open from the top. However, normally it has a single slit and opens as a triangle, flapping from the top of the slit to an end of its free bottom. A bottom bar may be provided along its free bottom to maintain the bottom straight and to weigh it down for closure.

Preferably, the strip is stitched to the curtain webs at the door side of the slit, Where the curtain is for installation at a stair well or the like the flanges preferably extend away from the well with the strip arranged for the door to open outwards.

The curtain may also have signage on the door, preferably on the opening section of the door. It can be in the form of an exit sign with words or a visual representation to indicate that the door is able to open such as hands indicating where to push to open. Alternative representations can also be envisaged.

To help understanding of the invention, a specific embodiment thereof will now be described by way of example and with reference to the accompanying drawings, in which.

Figure 1:
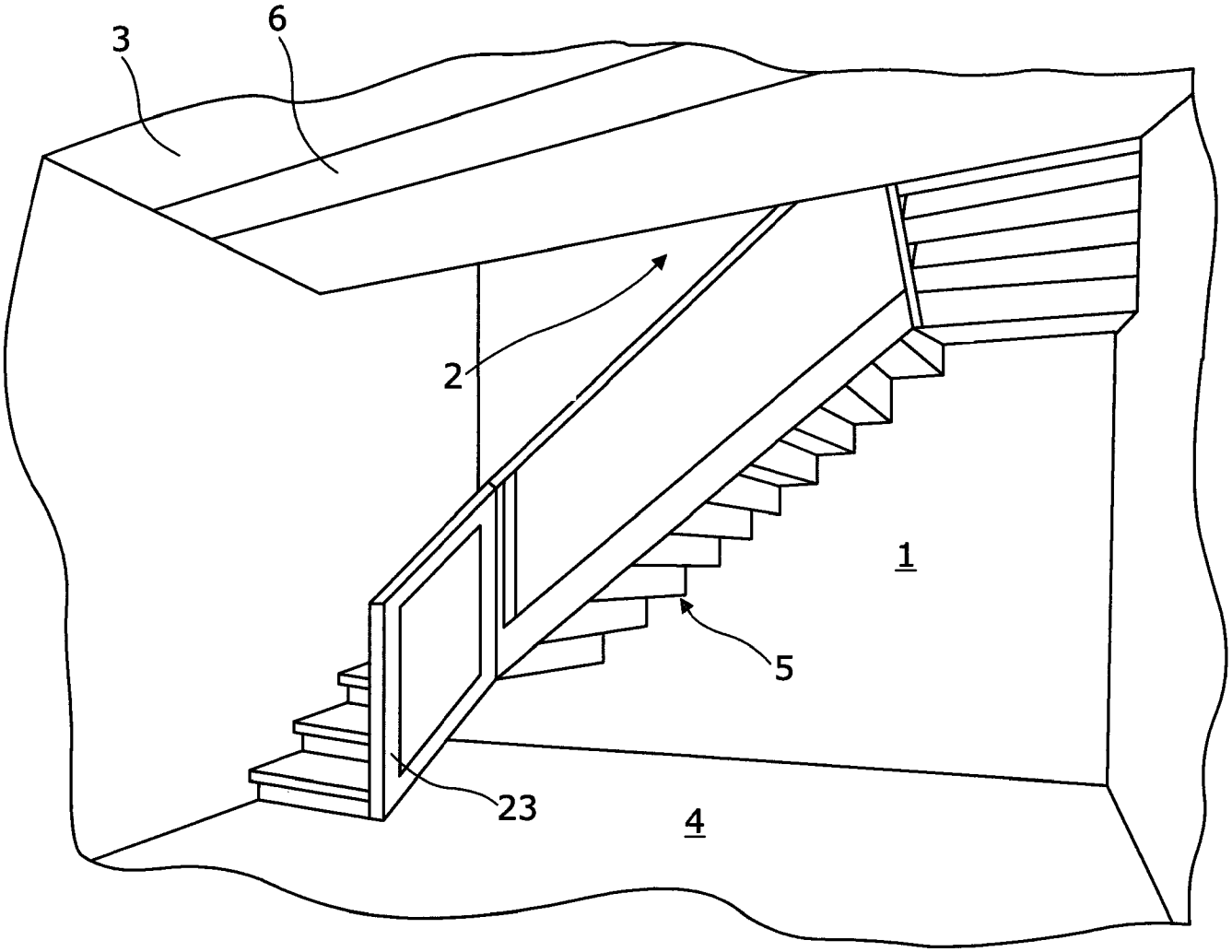
FIG. 1 is a perspective view of a stair well having a fire or smoke curtain of the invention installed in withdrawn position.
Figure 2:
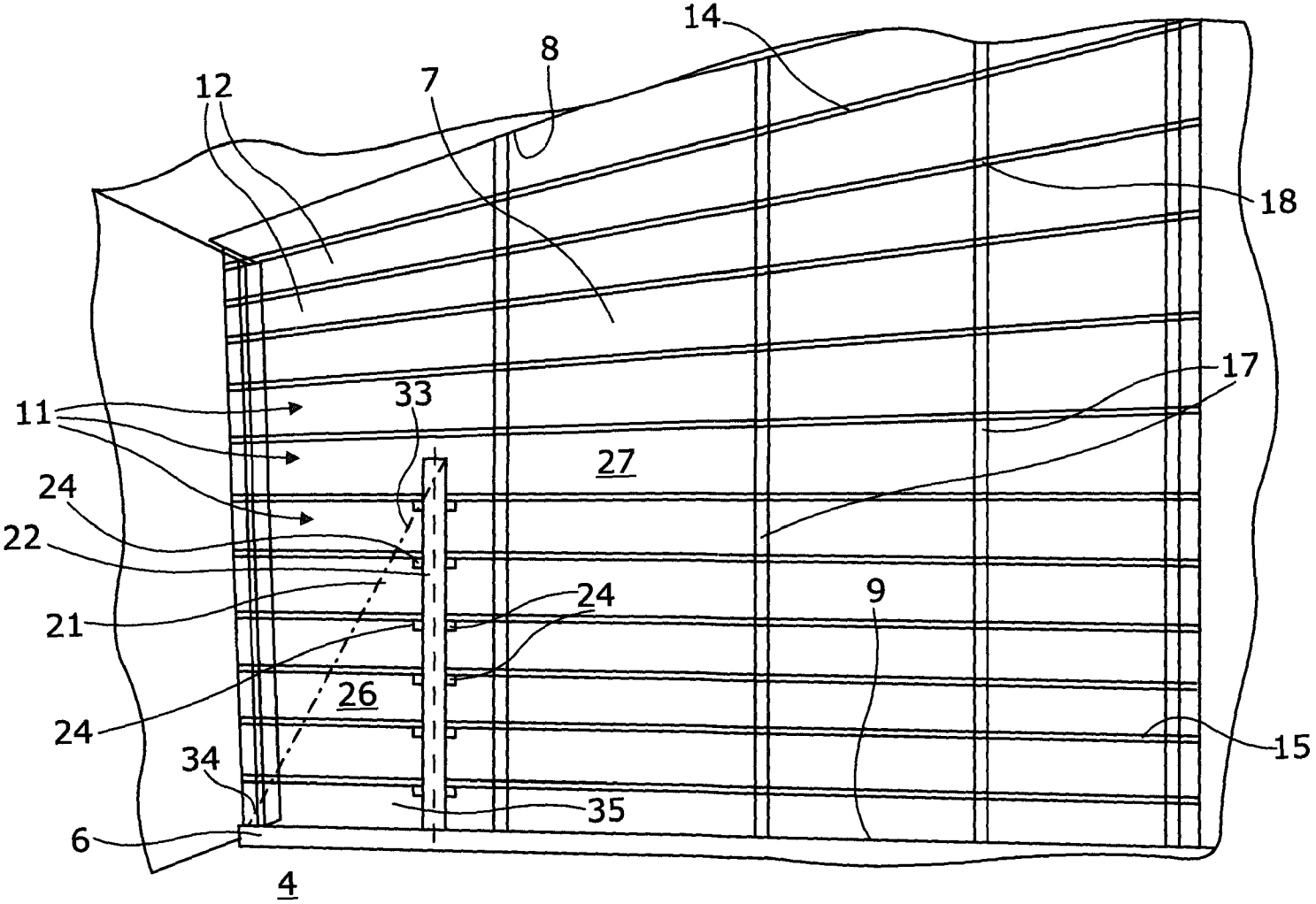
FIG. 2 is a view similar to FIG. 1 showing the curtain deployed and the arrangement of a door in it in accordance with the invention.
Figure 3:
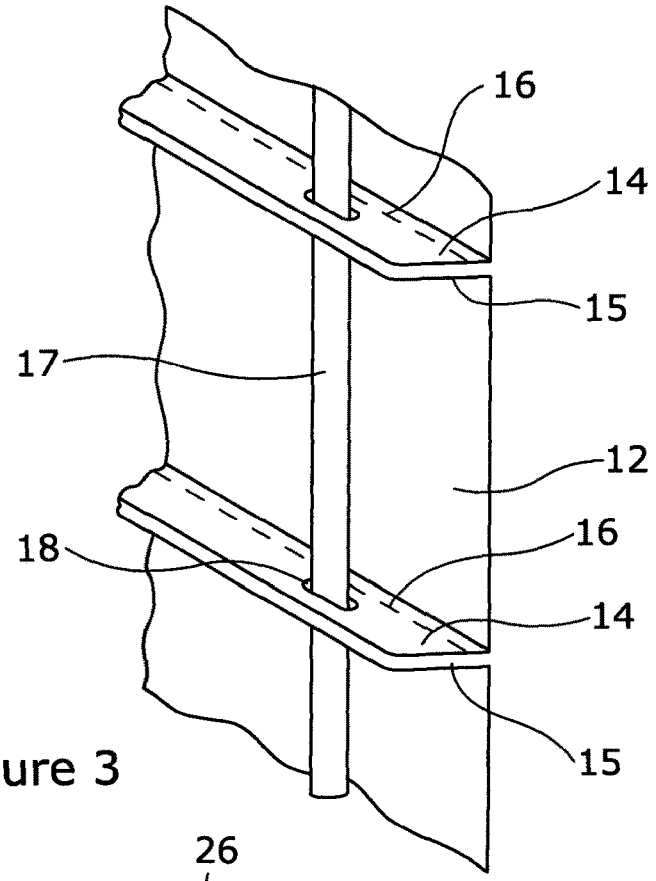
FIG. 3 is a scrap view of the curtain showing concertina panels and withdrawal straps.
Figure 4:
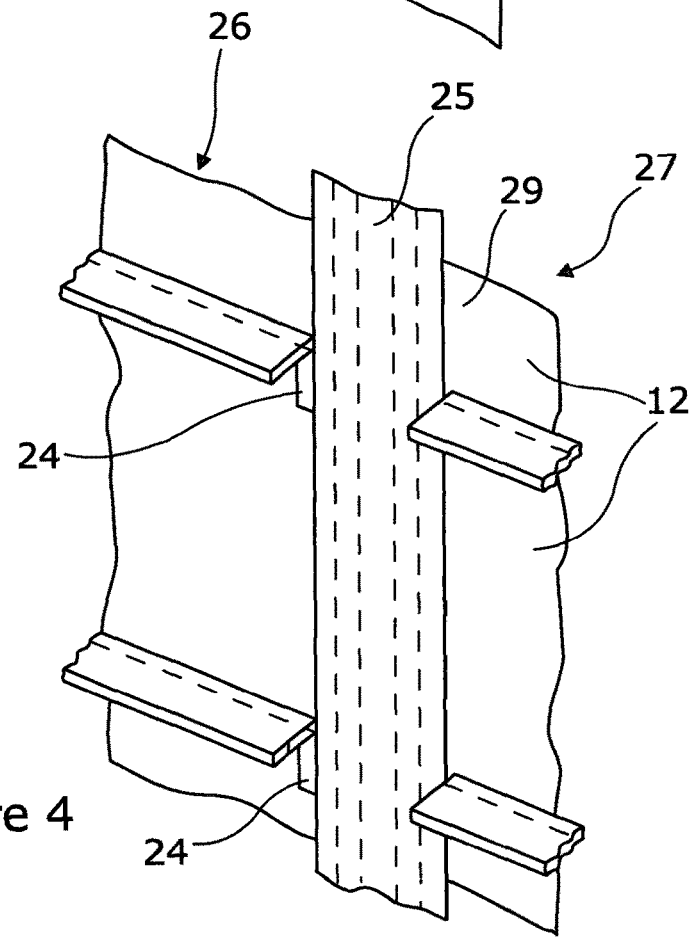
FIG. 4 is a similar scrap view showing a door edge strip.
Figure 5:
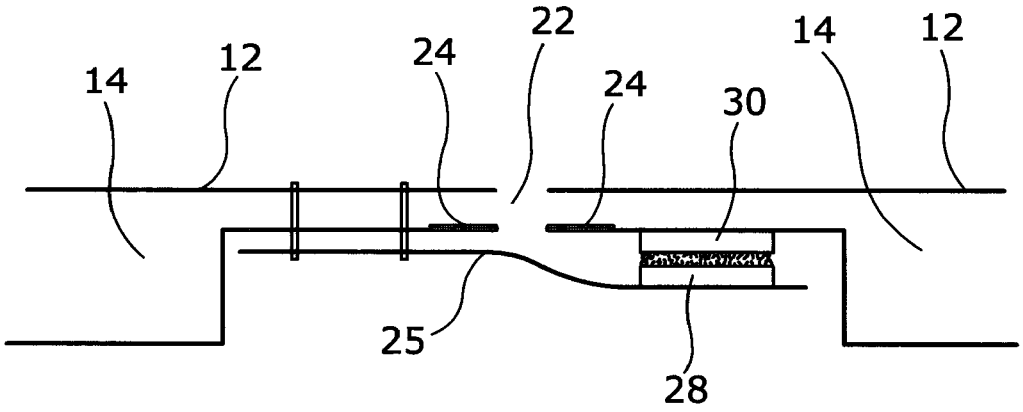
FIG. 5 is a scrap cross-sectional plan view of the strip.
Figure 6:
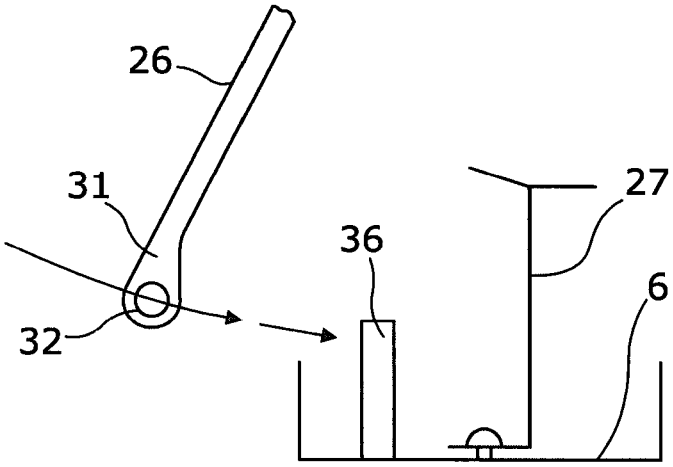
FIG. 6 is a scrap cross-sectional view in an orthogonal plane showing a weighting bar tending to close the door.

Referring to the drawings, a stair well 1 has an upper floor opening 2 in the ceiling 3 above a lower floor 4 with a staircase 5 from the upper floor to the lower floor. As shown in FIG. 1, a concertina curtain tray 6 is installed in the ceiling, normally supporting a concertina curtain un-deployed above it. FIG. 2 shows the curtain 7 deployed from the ceiling where a head end 8 of it is secured to a foot end 9 secured to the tray, now resting on the floor 4.

The curtain is formed from several panels 11 of fire resistant material, one above the other, each having a main web 12 and an upper and lower flange 14,15. These extend sideways from the deployed curtain, with the panels being stitched together at stitching joints 16 between the webs, with the flanges extending out from the joints. Straps 17 are provided down the fall of the curtain, through reinforced apertures 18 in the flanges. These stabilise the curtain in case of a pressure across the curtain and enables the tray's lifting, via a non-shown winding mechanism in the ceiling which lifts the tray and with it the curtain.

For provision of a personnel escape door 21, a slit 22 is provided up the bottom five webs of the curtain, adjacent to the newel post 23 at the foot of the stairs. The slit is through the flanges 14, 15 and the stitching joints 16. Adjacent the slit, the flanges are cut to the stitching 16 to provide portions 24 of the flanges that can be folded flat again the curtain webs, whilst allowing the rest of the flanges to extend out as normal. To the side of the curtain away from the stairwell, from which the flanges extend, and opposite the foot of the stairs, a strip 25 of the fire resistant material is stitched along the slit. The strip abuts the panel webs and the flanges folded against the webs. The arrangement causes a small but manageable, local thickening of the curtain when folded on the raised tray.

The strip allows a door portion 26 of the curtain to be flapped away from the rest of the curtain by a person escaping down the stairs after the curtain has deployed. The flap is moved out of abutment with the wall portion 27 of the curtain on the other side of the slit.

For sealing the curtain at the slit 22 and strip 25, the latter overlaps the wall portion is provided with stitched on hook and loop fastening tape 28 facing the edge 29 of the wall portion and the edge 29 is provided with a complementary tape 30. The latter tape is stitched over the webs and folded flanges in like manner to the strip 25. The tapes normally fasten the door portion 26 to the wall portion 27, with strength to resist pressure across the curtain. However the hook and loop fastening can be opened by an escapee.

Whilst the curtain is secured to the tray 6 at the foot of the wall portion, at the door portion of the curtain, it is stitched into a pocket 31 containing a weighing down bar 32, typically of steel. When the door portion is flapped open, pivoting about a line 33 extending from the top of the slit, obliquely to a point 34 close to the edge of the curtain opposite the foot of the stairs, the bar is lifted. Release of the door allows the door portion to drop the bar in closing of it. Its end 35 at the foot of the slit 22 is stopped by an abutment 36 provided on the tray. The hook and loop fastening closes the strip against the wall portion of the curtain.

The invention is not intended to be restricted to the details of the above described embodiment. For instance, the strip could be stitched to the wall portion to overlap the edge of the door. Further where it is expected that any fire emergency is likely to cause a pressure differential across the door such that inwards opening of the door is required, or if possible escapee egress might be in eight direction, loop handles can be stitched to the door at the slit to enable it to be pulled towards an escapee.

The invention claimed is:

1. A concertina smoke or fire barrier comprising:

a curtain having:

a plurality of panels, each having:

a web, and two flanges, and a stitching joint between each adjacent pair of panels, with one of the two flanges of each panel extending from the stitching joint, a normally closed door opening in the curtain, the door opening being provided by:

a slit extending through the curtain webs and flanges of the panels, cuts in the flanges next to the slit allowing flange portions between the slit and the cuts to be stitched against their webs, a strip of curtain web material stitched along the length of the slit to the curtain webs to one side of the slit for covering it when the door opening is closed, two complementary hook and loop fastening tapes, one piece of the tape being stitched to the strip and another complementary piece being stitched to the curtain webs to the other side of the slit.

2. A concertina smoke or fire barrier as claimed in claim 1, wherein the flange portions, and the flanges, comprise two thicknesses of curtain web material.

3. A concertina smoke or fire barrier as claimed in claim 2, wherein the strip, and the complementary piece of tape, are stitched over one of the cut flange portions.

4. A concertina smoke or fire barrier as claimed in claim 1, wherein the curtain has a tray to which a curtain's foot is secured and/or in which the foot is folded prior to deployment.

5. A concertina smoke or fire barrier as claimed in claim 4, wherein a normally closed door part of the curtain next to the slit is free from the tray for opening of the normally closed door part.

6. A concertina smoke or fire barrier as claimed in claim 1, wherein a normally closed door part of the curtain has at least one slit along two sides of the normally closed door, to enable it to flap open from a top and having a free bottom.

7. A concertina smoke or fire barrier as claimed in claim 1, wherein a normally closed door part of the curtain has a single slit and opens as a triangle, flapping from a top of the slit to an end of a free bottom of the normally closed door part.

8. A concertina smoke or fire barrier as claimed in claim 1, wherein a bottom bar is provided along a free bottom to maintain a bottom straight and to weigh the bottom down for closure.

9. A concertina smoke or fire barrier as claimed in claim 1, wherein the strip is stitched to the curtain webs at a door part of the curtain.

10. A concertina smoke or fire barrier as claimed in claim 1, wherein where the curtain is adapted for installation at a stair well, the flanges extend away from a side of the curtain having the strip arranged for a normally closed door part of the curtain to open outwards from a direction of a fire.

11. A concertina smoke or fire barrier as claimed in claim 1, wherein the curtain has signage to indicate a normally closed door part of the curtain can be opened.

* * * * *